US005422463A

United States Patent [19]

Gooray et al.

[11] Patent Number: 5,422,463

[45] Date of Patent: Jun. 6, 1995

[54] DUMMY LOAD FOR A MICROWAVE DRYER

[75] Inventors: Arthur M. Gooray; Kenneth C. Peter, both of Penfield, N.Y.

[73] Assignee: Xerox Corporation, Stamford, Conn.

[21] Appl. No.: 159,358

[22] Filed: Nov. 30, 1993

[51] Int. Cl.[6] ..... H05B 6/70

[52] U.S. Cl. ..... 219/694; 219/695; 219/696; 219/759; 219/692; 333/22 F; 34/259

[58] Field of Search ..... 219/694, 695, 692, 687, 219/759, 696; 333/22 F; 34/259, 260

[56] References Cited

U.S. PATENT DOCUMENTS

| | | | |
|---|---|---|---|
| 2,958,830 | 11/1960 | Bird et al. | 219/694 |
| 3,040,252 | 6/1962 | Novak | 333/22 F |
| 3,584,389 | 6/1971 | Hilton et al. | 34/1 |
| 3,599,127 | 8/1971 | Krijger | 333/22 F |
| 3,617,953 | 11/1971 | Kingma et al. | 333/17 |
| 3,621,481 | 11/1971 | Perreault et al. | 333/22 F |
| 3,672,066 | 6/1972 | Stephansen | 34/1 |
| 3,739,130 | 6/1973 | White | 219/10.55 |
| 3,783,414 | 1/1974 | Klein et al. | 333/22 |
| 3,796,973 | 3/1974 | Klein | 333/22 |
| 4,234,775 | 11/1980 | Wolfberg et al. | 219/10.55 |
| 4,286,135 | 8/1981 | Green et al. | 219/10.55 |
| 4,469,026 | 9/1984 | Irwin | 101/426 |
| 4,593,259 | 6/1986 | Fox et al. | 333/22 F |
| 4,625,089 | 11/1986 | Gics | 219/694 |
| 4,638,268 | 1/1987 | Watanabe et al. | 333/22 F |
| 4,711,983 | 12/1987 | Gerling | 219/694 |
| 4,754,238 | 6/1988 | Schüller et al. | 333/22 |
| 4,799,031 | 1/1989 | Lang et al. | 333/22 F |
| 4,939,787 | 7/1990 | Rubin | 333/22 F |
| 5,079,507 | 1/1992 | Ishida et al. | 324/645 |

FOREIGN PATENT DOCUMENTS

| | | | |
|---|---|---|---|
| 1050493 | 12/1966 | United Kingdom | 219/694 |

OTHER PUBLICATIONS

Emerson & Cumming, "Machinable Rod Bar and Sheet Stock with Lossy Magnetic Loading", *Eccosorb ® MF*, T.B. Feb.-Jun. 4, 1982.

*Primary Examiner*—Philip H. Leung
*Attorney, Agent, or Firm*—Daniel J. Krieger

[57] ABSTRACT

A matched or dummy load for a microwave dryer having a microwave generator and a microwave applicator. The matched load includes a waveguide having opposed broad walls, opposed narrow walls, and an end wall defining a waveguide chamber. A power absorbing body made of sintered silicon carbide, casted silicon carbide, or other materials is disposed in the waveguide chamber. One or more of the walls includes means for transferring heat from the power absorbing body. A housing or shroud having an inlet and an outlet surrounds the waveguide. The means for removing heat is disposed between the inlet and outlet of the housing so that a cooling medium passed through the housing removes heat from the power absorbing body. A tuning stub is placed in front of the power absorbing body to reduce microwave reflections.

38 Claims, 12 Drawing Sheets

DUMMY LOAD FOR A MICROWAVE DRYER

CROSS-REFERENCE TO RELATED APPLICATION

Cross-reference is made to patent application Attorney Docket No. D/93143 entitled "Apparatus and Method for Drying Ink Deposited by Ink Jet Printing" and patent application Attorney Docket No. D/93144 entitled "Phase Shifter for Fine Tuning Microwave Applicator" being filed concurrently herewith.

FIELD OF THE INVENTION

The present invention relates generally to drying ink deposited by an ink jet printer and more particularly relates to a dummy load for use in microwave dryer.

BACKGROUND OF THE INVENTION

Many inks and particularly those used in thermal ink jet printing include a colorant and a liquid which is typically an aqueous liquid vehicle. Some thermal ink jet inks also include a low vapor pressure solvent. When a substrate or a sheet of paper is printed with ink jet ink, the ink is deposited on the substrate to form an image in the form of text and/or graphics. Once deposited, the liquid is removed from the ink and paper to fix the ink to the substrate. The amount of liquid to be removed, of course, varies with the amount of ink deposited on the substrate. If a sheet is covered with 10% printing, as in text only printing, the amount of liquid to be removed is quite small. If the sheet is covered with 90% printing, however, as when a graphic image is printed, the amount of liquid to be removed is substantially more and can cause image defects and paper deformation if not removed very rapidly.

Liquid can be removed from the ink and printed substrate by a number of methods. One simple method is natural air drying in which the liquid component of the ink deposited on the substrate is allowed to evaporate without mechanical assistance resulting in natural drying. Another method is to send the printed substrate through a dryer to evaporate the liquid. In some cases a special paper is used in which the liquid is absorbed by a thin coating of absorptive material deposited on the surface of the paper. Blotting of the printed substrate is also known.

In the case of natural drying, almost 100 percent of the liquid is absorbed into the paper and is then, over a long period of time, evaporated naturally. The absorption and desorption of water into and out of the paper, however, has some undesirable side effects, such as long drying time, strike through, feathering at edges of the printed image, paper curl and paper cockle. In the case of paper cockle, the absorption and desorption of the water relaxes the internal stresses of the paper and results in deformations known as cockle. Cockle is also a function of the amount of liquid deposited per unit area. Less printing on a page has less potential to develop cockle due to the smaller amount of liquid. More printing on a page has more cockle potential due to a higher amount of liquid per unit area. Cockle can also be induced by heating of the paper, which results in stress relief.

Ink compositions also have an effect on the drying rates and drying efficiency. For example, highly absorptive (fast drying) inks while requiring less ink to be removed by a dryer are prone to image quality defects such as leathering, raggedness, and strike through. On the other hand, slightly absorbtive inks require more power from a dryer to dry since more ink requires evaporation.

The rate at which the image is dried is also critical for controlling the print quality. A slow drying rate can achieve ink permanence or drying effectiveness but also can result in image quality defects such as excessive image leathering or strike through. Additionally, a slow drying rate can result in image offset (ink from one sheet of paper is transferred to another sheet of paper because the ink has not dried completely), smear and spreading from contact with exit rolls, baffles and output stacking of the individual sheets. A very fast drying rate can result in image mottle and image spatter.

Drying rates are particularly critical when substrates are printed at high rates of speeds. Not only must image deformations and paper deformations be controlled, but the drying times must be short due to the high printing rates to ensure no offset at exit rolls.

A dryer must achieve image fixing (no offset/smear) and good image quality to reduce or prevent image disturbance, distortion, feathering and strike through. In addition the dryer must preferably reduce or eliminate cockle and curl. Besides the slow speed of conventional dryers, many dryers produce uneven drying rates resulting in uneven drying patterns. To shorten drying times, infrared drying techniques have been adopted. This method can, however, cause browning of paper during paper jams due to the elevated temperatures produced by the infrared heat.

Microwave dryers have been used for drying materials such as ink on paper with varying degrees of success. Microwave dryers of various types are described in, for example, U.S. Pat. Nos. 3,584,389, 3,672,066, 3,739,130, 4,234,775 and 4,469,026.

Microwave dryers typically include a dummy or matched load or matching termination to absorb any power which has not been absorbed by the material being dried. Known matched loads include water loads, and water cooled loads, both of which are impractical where low cost and small size requirements are a consideration.

U.S. Pat. No. 3,617,953 to Kingma et al. describes a microwave impedance matching system for matching a microwave input waveguide to a microwave output waveguide. A first and second electromechanical phase shifter are moved transversely in waveguide sections to produce varying amount of differential phase shift.

U.S. Pat. No. 3,783,414 to Klein et al. describes a termination for a transmission line or waveguide of small weight and size capable of absorbing high levels of power and capable of achieving a VSWR in the order of 1.05 to 1.20 over 10–20 percent frequency bands.

U.S. Pat. No. 3,796,973 to Klein describes a termination for transmitting or absorbing a signal transmitted through a transmission line or waveguide.

U.S. Pat. No. 4,286,135 to Green et al. describes a waveguide isolator having microwave ferrite bars to reduce energy reflected into the microwave source. A blower fan draws air past the microwave source and through a waveguide to provide cooling.

U.S. Pat. No. 4,754,238 to Schuller et al. describes a microwave absorber including a hollow body consisting of microwave-absorbing material which is arranged in a housing. At least one inlet and one outlet are provided for a gaseous cooling fluid which streams through the container to carry away heat produced by microwave energy which has been absorbed by the absorbing body.

U.S. Pat. No. 5,079,507 to Ishida et al. describes an automatic impedance adjusting apparatus for adjusting an impedance seen looking toward a microwave load. A cooling air outlet exhausts cooling air into a circular waveguide.

British Patent Specification No. 1,050,493 to Hilton describes microwave heating and/or drying of sheet material, for example paper in order to dry ink which has been applied by a printing process. The apparatus comprises a plurality of waveguide sections provided with slots in the sides thereof through which a sheet of material can be passed for drying. The waveguide sections are arranged in a serpentine manner. A microwave source is attached to one end of the waveguide and a load is attached to the other end of the waveguide.

SUMMARY OF THE INVENTION

In accordance with one aspect of the present invention, there is provided a dummy load for a microwave dryer. The load for the microwave dryer includes a waveguide defining a waveguide chamber. A power absorbing body is disposed in the waveguide chamber. Transfer means are associated with the power absorbing body for transferring heat from the power absorbing body.

Pursuant to another aspect of the present invention, there is provided a method of reducing reflected power in a microwave circuit having a microwave power generator coupled to a microwave applicator terminated by a dummy load having an adjustable tuning stub. Generated microwave power is applied to the load through the applicator to raise the temperature of the load. The temperature of the load is measured and the adjustable tuning stub is adjusted to reduce the reflected power to approximately zero when the measured temperature reaches a predetermined value.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention. Consequently, many modifications and variations are possible in light of the teachings herein by those skilled in the art as expressed in the specification and the appended claims.

DETAILED DESCRIPTION OF THE INVENTION

Figure 1:
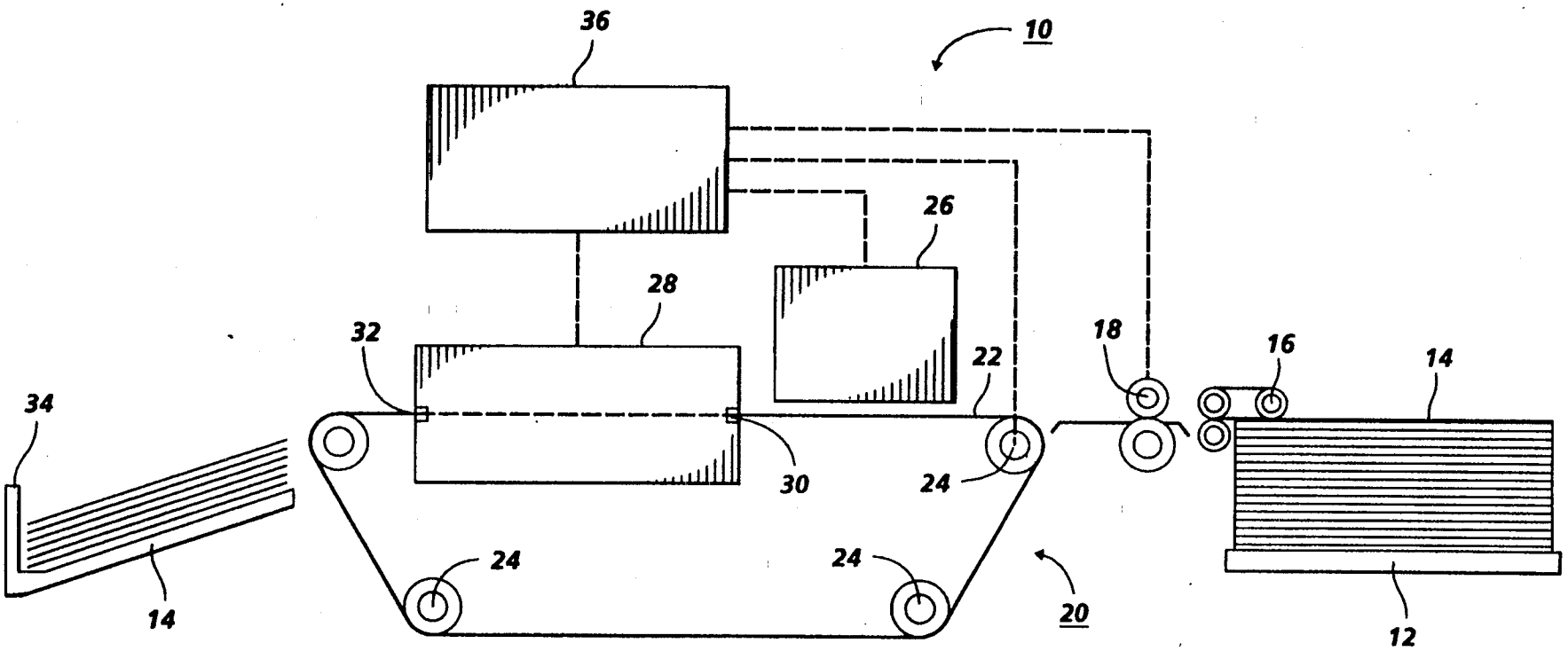
FIG. 1 is a schematic elevational view of an ink jet printer suitable for use with the present invention.

FIG. 1 illustrates a schematic view of an ink jet printer 10 of the present invention. The ink jet printer 10 includes an input tray 12 containing cut sheets 14 of paper stock to be printed upon by the ink jet printer 10. Single sheets 14 of paper are removed from the input tray 12 by a pick-up roller 16 and fed by feed rollers 18 to a paper transport mechanism 20. The paper transport mechanism 20 moves the sheet 14 by a feed belt or belts 22 driven by rollers 24 beneath a printing member 26. The belts 22 are made of a material transparent to microwave power having a low dielectric constant. The printing member 26 includes a pagewidth ink jet printhead which deposits ink on the sheet 14 as the sheet moves past the printhead. The pagewidth ink jet printhead is a linear array of print nozzles as wide as the sheet so that ink is deposited across the entire width of a sheet. The present invention is equally applicable, however, to printers having an ink jet printhead which moves across the sheet 14 periodically, in swaths, to form the image, much like a typewriter. The print member 26 includes an ink supply and the necessary electronics to control the deposition of ink on the page.

Preferably, ink specially formulated to be heated by microwave power is used. Such ink may include compounds designed to couple with the microwave power for increasing the amount of heat conducted thereby. One such compound is an ionic compound at least partially ionizable in the liquid vehicle. U.S. Pat. No. 5,220,346, entitled "Printing Processes with Microwave Drying", assigned to Xerox Corporation, discloses a suitable ink and is hereby incorporated in this application by reference.

Once the sheet 14 has been printed, the sheet 14 is carried by the paper transport, immediately after printing or within about 5 seconds or less, to a microwave dryer 28. The sheet enters an input slot 30 and exits an output slot 32. A transport mechanism, such as one using a vacuum applied to the bottom side of the paper or one using a static mat carries the paper through the microwave dryer 28. As the sheet 14 passes through the microwave dryer 28, microwave power is delivered to the sheet 14 to thereby dry the ink deposited thereon. Once the sheet 14 is substantially dry, the sheet is sent to an output tray 34.

A controller 36 controls the printing member 26, the microwave dryer 28, and the paper transport mechanism 20 as would be understood by one skilled in the art. In addition, an adaptive dryer control for ink jet processors can also be used. U.S. Pat. No. 5,214,442, entitled "Adaptive Dryer For Ink Jet Processors", assigned to Xerox Corporation, discloses such an adaptive dryer control and is hereby incorporated in this application by reference.

Microwave dryer 28 has such a fast drying rate that the excess liquid in the ink on the substrate is evaporated from the surface of the printed sheet before any appreciable absorption occurs. Additionally, microwave power generated in the dryer 28 produces an electric field sufficiently large to effectively dry a thin layer of ink on the paper substrate.

To control image quality defects in the ink jet printer 10, ink is deposited on the substrate from printhead 26, and the printed substrate is passed to dryer 28 for rapid drying. Preferably, the substrate travels through dryer 28 at a speed ranging from about 2 inches to 20 inches per second, or from about 10 prints to 200 prints per minute. In the printer 10 described above, input slot 30 is located approximately three inches from printhead 26. With the paper speed of 2 to 20 inches per second, the total time from depositing the ink on the substrate to enter the dryer is approximately 1.5 seconds to 0.15 seconds. Thus, using a serpentine dryer, for example, with a total drying zone of 6.75 inches, the substrate exits the dryer in 5 to 0.5 seconds.

Figure 2:
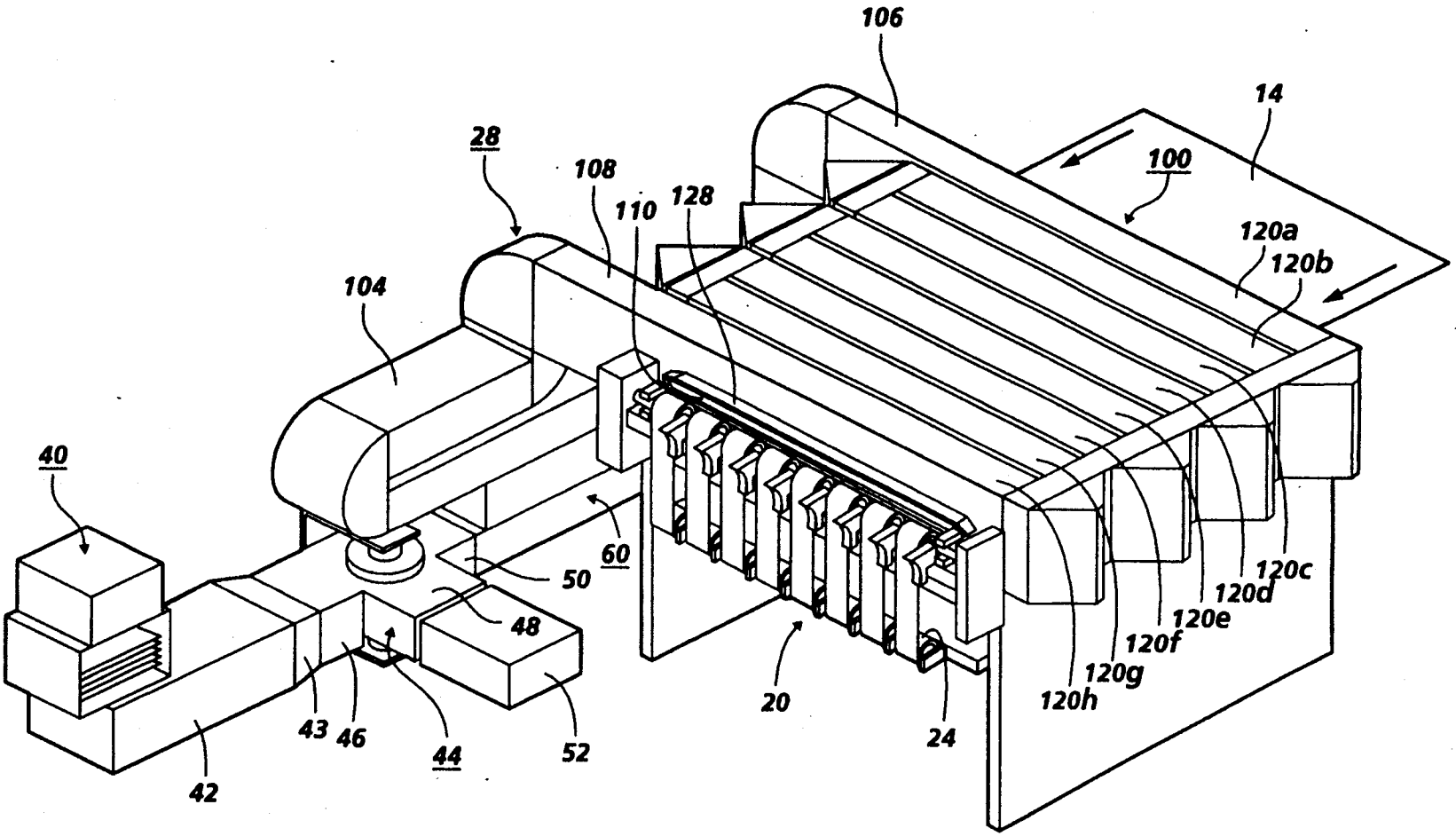
FIG. 2 is a perspective view of a microwave dryer in accordance with the present invention.

FIG. 2 illustrates one embodiment of the microwave dryer 28. The microwave dryer 28 comprises a traveling wave resonator which enhances the field intensity to which the paper is exposed. By using a traveling wave resonator, the electric field intensity sufficient to dry ink effectively is possible with a relatively low power (less than 1.5 kW) magnetron. In addition, because traveling waves are used, uniformity of heating is much better than if standing waves are used and the applicator is not greatly affected by differences in the load or the paper and the amount of ink coverage.

The paper transport mechanism 20 moves paper through the microwave dryer 28 by a belt or plurality of belts carried by the rollers 24. The microwave dryer 28 includes a microwave generator 40 for generating microwaves. The microwave generator 40 includes a 2455 MHz fixed frequency magnetron and a magnetron power supply as is understood by one skilled in the art. Such magnetrons are commonly used in household microwave oven applications and are available from several Japanese manufacturers at low cost. A magnetron generator with a power in the range of approximately 500–1500 watts is preferably used to generate the microwaves.

As seen in FIG. 2, the microwave generator 40 is connected to a waveguide launcher 42. The waveguide launcher 42 is a mount for the magnetron that allows the magnetron to radiate efficiently into a waveguide. The waveguide launcher 42 includes a transition section 43. The transition section 43 connects the output of the launcher 42 to a circulator 44 having a first port 46, a second port 48 and a third port or main waveguide feed 50. The second port 48 is coupled to a matched load 52.

The circulator 44 is used to ensure stable operation of the magnetron under the operating conditions. The circulator is a nonreciprocal ferrite device that allows power to flow from the microwave generator 40 to a microwave applicator. The matched load 52 absorbs reflected power to protect the magnetron 40 from damage. The matched load 52 includes a tuning screw to permit fine tuning of the circuit to have a termination Voltage Standing Wave Ratio (VSWR) of less than 1.02.

Figure 3:
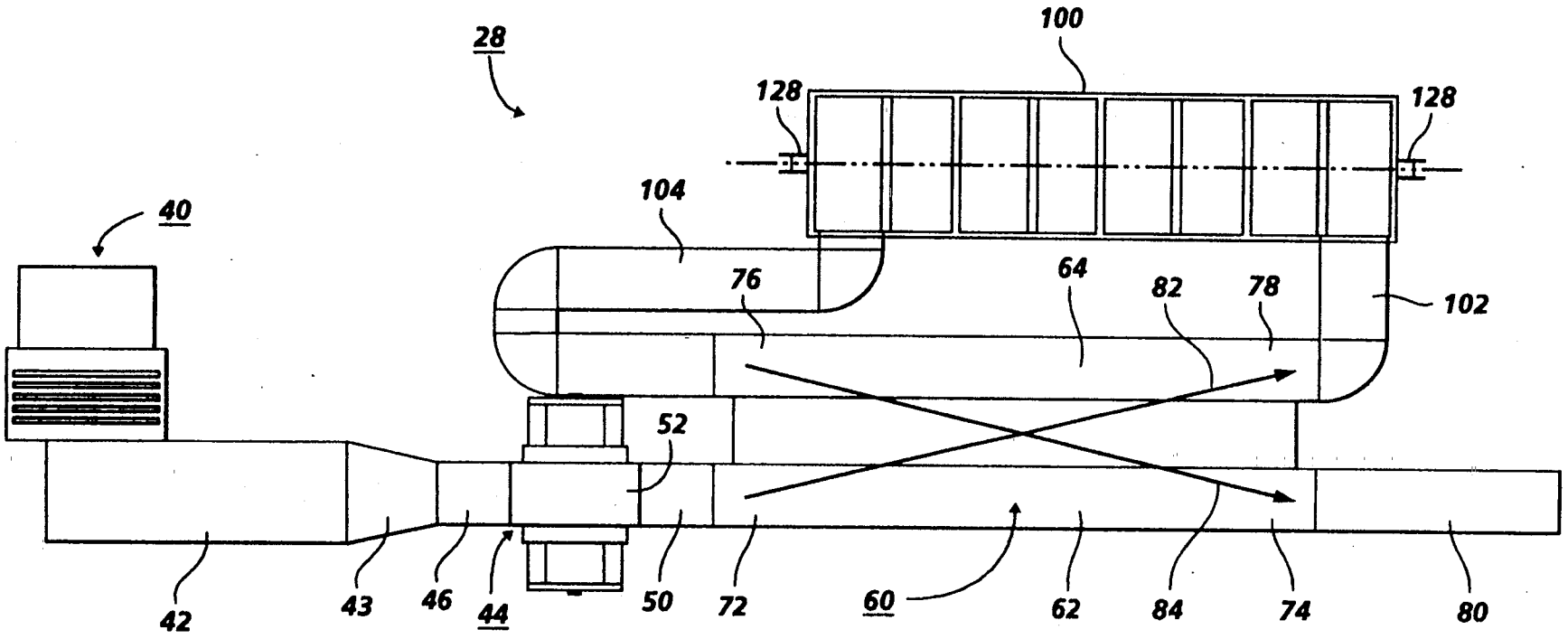
FIG. 3 is an elevational view of the FIG. 2 microwave dryer.
Figure 4:
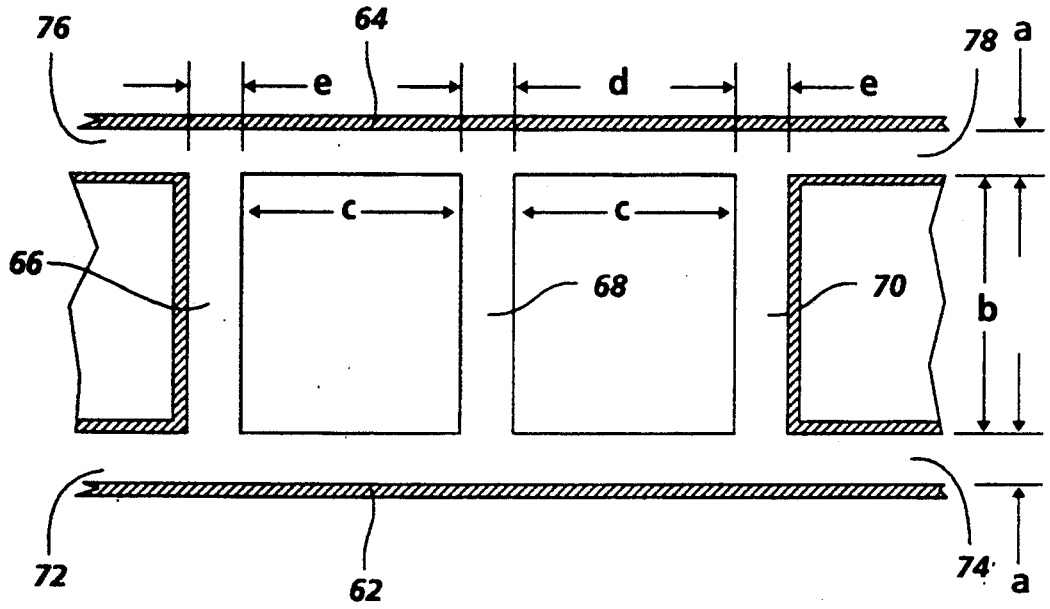
FIG. 4 is a sectional plan view of a three-branch coupler.

A branch guide directional coupler 60 is connected to the main waveguide feed 50 as shown in FIG. 3. The directional coupler 60 comprises a main waveguide 62 and an auxiliary waveguide 64 more clearly seen in FIG. 4. The main and auxiliary waveguides are connected together by a first, a second and a third branch waveguide 66, 68, and 70 respectively. Each of the branch guides is nominally a quarter of a guide wavelength long.

The main waveguide 62 has a first arm 72 and a second arm 74. The auxiliary waveguide 64 has a third arm 76 and a fourth arm 78. When power flows in the main waveguide 62 from the first arm 72, some power will be coupled to the auxiliary waveguide through the branch waveguides 66, 68 and 70 and some power flows out the fourth arm 78. When power flows in the auxiliary waveguide 64 from third arm 76 to the fourth arm 78, some of the power is coupled to the main waveguide and flows out the second arm 74. The extent to which power is coupled between the main and auxiliary waveguides, i.e. the coupling, is determined by the dimensions of the branch guides. Currently, the branch guide directional coupler 60 is a 3.0 dB coupler having the following dimensions: a=1.22 inches; b=1.955 inches; c=1.620 inches; d=0.920 inches; and e=0.523 inches. A matching termination or matched load 80 is coupled to the second arm 74 for terminating thereof.

A first arrow 82 and a second arrow 84 shown in FIG. 3 illustrate the flow of power through the branch guide directional coupler 60. The first arrow 82 illustrates the flow of power from the first arm 72 to the fourth arm 78 and into a serpentine applicator 100. The second arrow 84 illustrates the flow of power from the third arm 76 into the second arm 74 and into the matching termination 80.

The branch guide directional coupler 60 is connected to a serpentine applicator 100 as illustrated in both FIGS. 2 and 3. The serpentine applicator 100 receives microwave power from the fourth arm 78 of the coupler 60 through a first microwave guide 102. Power exiting the serpentine applicator 100 enters the third arm 76 of the coupler 60 through a second microwave guide 104. The second microwave guide 104 can include an adjustable phase shifter for fine tuning the microwave circuit.

Figure 5:
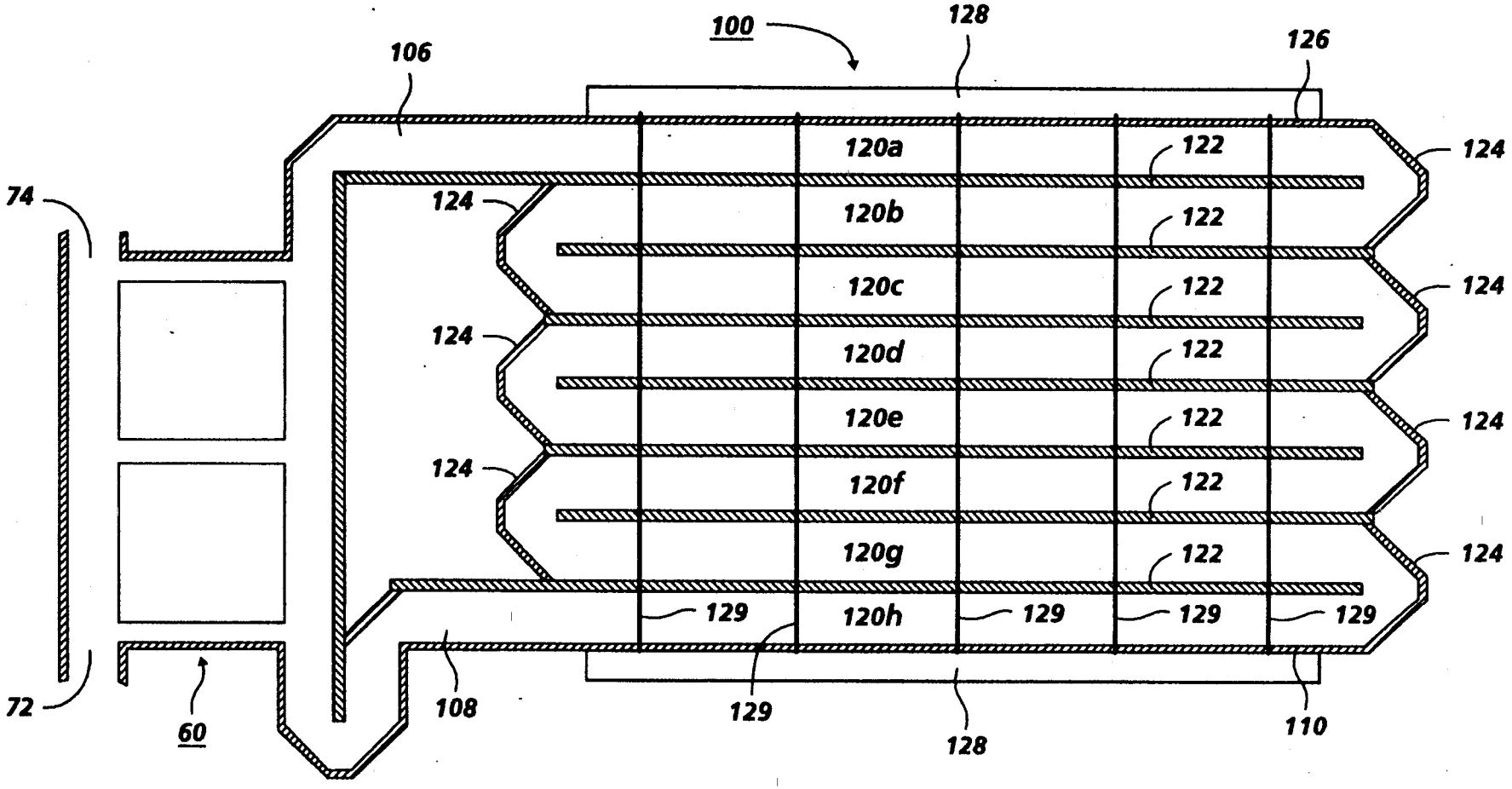
FIG. 5 is a sectional view of a three-branch coupler and an eight pass serpentine applicator.

Returning to FIGS. 2 and 3, the serpentine applicator 100 has an input 106 connected to the first microwave guide 102 and an output 108 connected to the second microwave guide 104. A sheet of paper 14 passes through the serpentine applicator 100 and exits through a slot 110. The paper 14 enters the applicator on the opposite side but is not show in FIG. 2. As shown in FIG. 5, the serpentine applicator 100 is an eight branch serpentine applicator having generally parallel guide sections or branches **120*a* through 120*h*. Each branch 120 has a height of 2.84 inches and a width of 0.67 inches. As microwave power enters the input 106, the power travels through each branch starting at the first branch 120*a* and ending at the branch 120*h* and to the output 108. The serpentine applicator 100 has a length selected so that the effective electrical length of the traveling wave resonant circuit comprising the serpentine applicator 100 and the directional coupler 60 is equivalent to an integral number of guide wavelengths. With proper adjustment of the length, the microwave circuit becomes a traveling wave circuit resonating at the resonant frequency. In order for the resonant system to function properly, the system resonant frequency and the magnetron frequency must be matched to within a frequency of up to ±5 MHz. In addition, the waveguide launcher 42** includes a tuning screw or a phase shifter to permit a one-time optimization of system performance.

FIG. 5 illustrates a sectional view of one-half, of the coupler 60 and the serpentine applicator 100. The coupler 60 and the guides 106 and 108 are shown on the same plane as the serpentine applicator 100 for illustration. The interior of the serially interconnected generally parallel guide sections 120*a* through 120*h* joined by U-shaped connecting sections 124 is also shown. Each guide section 120 is connected to the next and partially separated therefrom by a member 122. The connecting sections 124 transmit the microwave power from one guide section to the next guide section with minimum reflections and loss of power. A sheet of paper enters through a slot 126 which is substantially similar to the slot 110 previously described and exits through the slot 110. Paper guide members comprising microwave transparent material such as Teflon TM or polytetraflouroethylene string are attached to the underneath side of the top half of the serpentine applicator 100 from one slot to the other slot to prevent paper from being caught therein when passing from the slot 126 to the slot 110. In addition, Teflon TM is hydrophobic and consequently does not disturb the ink. Both the slot 126 and the slot 110 are surrounded by a lip member 128 shown in FIGS. 2 and 6. Only one half of the lip is illustrated in FIG. 5. The lip member 128 comprising one-half on the top half and onehalf on the bottom half of the serpentine applicator serves as a guide and also as a choke for preventing leakage of microwave power from the serpentine applicator 100. For a more detailed description of the slot 110, the U-shaped connecting section 124, and the lip member 128 refer to co-pending application Attorney Docket Number D/93143 entitled "Apparatus and Method for Drying Ink Deposited by Ink Jet Printing" filed concurrently herewith and herein incorporated by reference.

As microwave power is transmitted from one guide section to the next, the amount of power available for drying in each guide section changes from a relatively large amount of power available in guide section 120*a* to a relatively small amount of power available in guide section 120*h*. For instance, the ratio of electric field strength in the first guide section 120*a* to electric field strength in the last guide section 120*h* is approximately 2 to 1.

Consequently, paper printed with inks having rapid penetration rates may be input to the slot 126 and exit the slot 110 to apply the greatest amount of power to the ink/paper as soon as possible. Paper printed with inks having slow penetrating rates, however, may be input to the slot 110 and exit the slot 126 so that the amount of microwave power applied to the ink/paper increases as the paper travels through the applicator 100. By not applying as much power initially, since the paper passes through guide section 120*h* first, the slower absorbing inks are not heated as rapidly, and so image quality defects, such as mottle and spatter, which can result from slower absorbing inks sitting on the surface of the paper are reduced or prevented altogether. In this way, the final image quality for all types of inks is the same.

Figure 6:
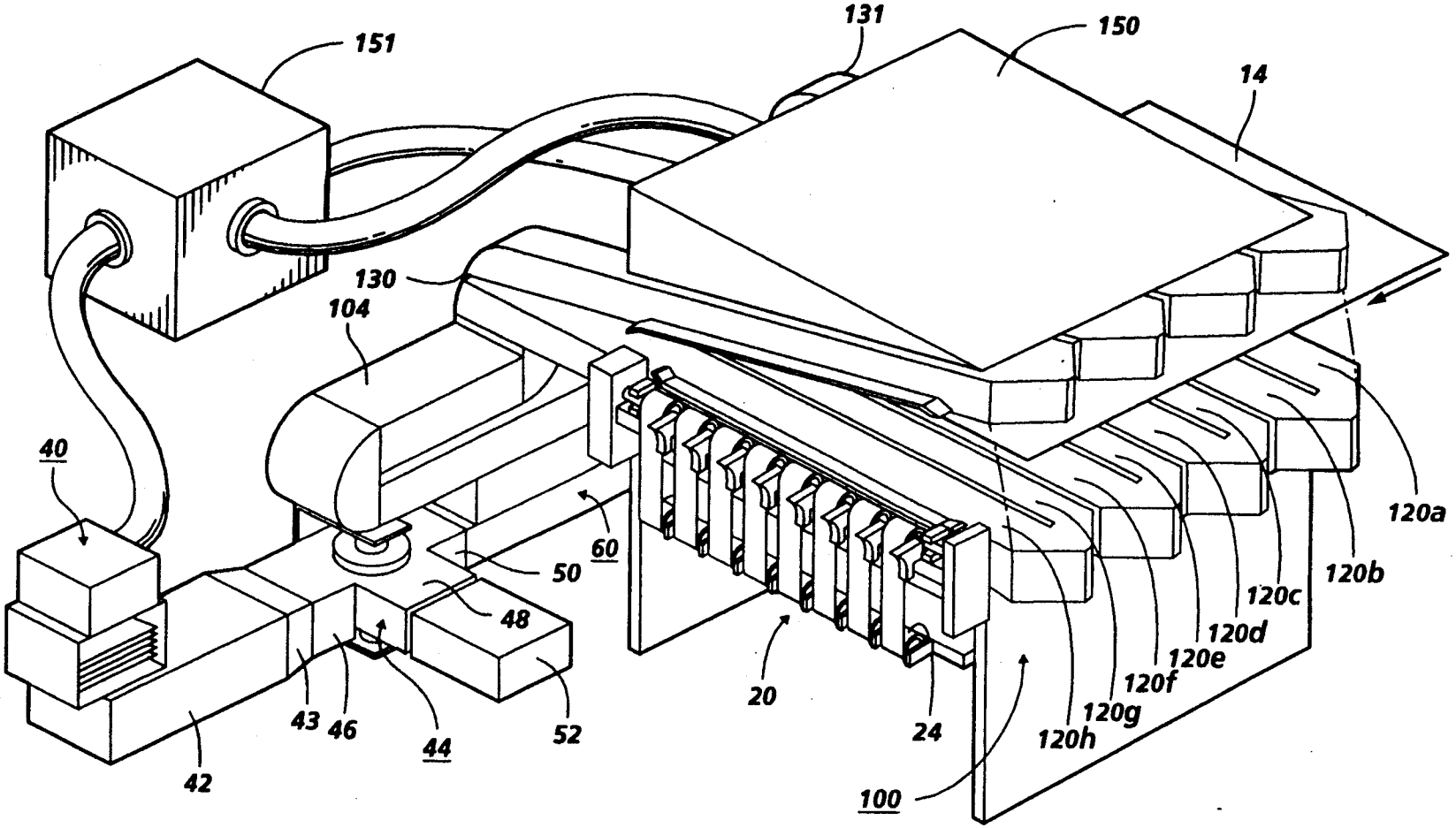
FIG. 6 is a perspective view of a microwave dryer and a manifold of the present invention.
Figure 7:
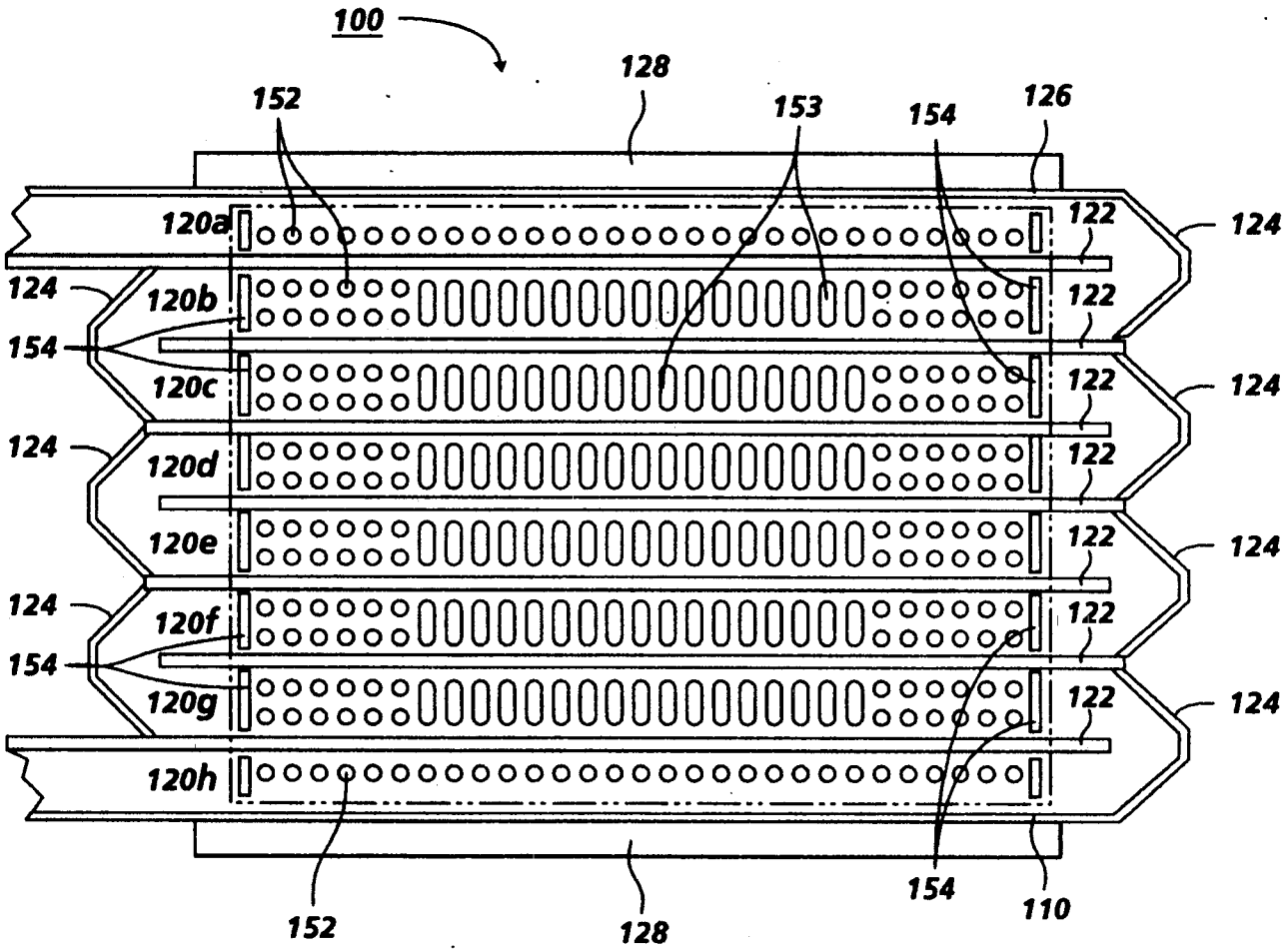
FIG. 7 is a plan view of the serpentine applicator defining holes for the application of convective hot air for drying.

FIG. 6 illustrates the microwave dryer 28 including a manifold 150 which sits atop the serpentine applicator 100. In this embodiment, the applicator 100 is hinged at locations 130 and 131 to provide access to the interior thereof for paper removal if necessary. In the figure, the applicator 100 and manifold 150 is shown in a raised position. The manifold 150 supplies forced hot air to the top surface of the paper to provide convective hot air drying. Hot air is scavenged from the magnetron 40 and the matching termination 80 and forced by a blower 151 into the manifold 150. The manifold 150 is shaped like a wedge in which the height at the portion receiving forced air from the blower 151 is greater than the height of the distant end thereof. By angling the top surface of the manifold 150, the serpentine applicator may be opened without being obstructed by the manifold due to any frame or machine which may be located above the manifold 150. The hot air passes through a plurality of holes 152 and/or slots 153 defined in the top of the serpentine applicator 100 as illustrated in FIG. 7. FIG. 7 also illustrates the interior of the serpentine applicator located above the side of paper having wet ink. Hot air impinges upon the wet surface of the sheet of paper through the holes 152 and slots 153. A plurality of microwave transparent baffles 154, made of a microwave transparent material such as polystyrene, directs the flow of air to the sheet. Air is removed by means of a vacuum transport which is located below the bottom half of the applicator.

The holes and slots are sized to reduce or prevent microwave leakage from and/or reflections in the waveguide 120. In the present embodiment, the holes are 3 mm in diameter and the slots are 3 mm wide and 9 mm long. Other combinations of holes and slots can be used, but it has been found the slots allow for increased air flow to a sheet of paper for drying.

With a power output of the magnetron 40 of approximately 850 watts, a minimum of approximately 150 watts of thermal power is potentially available from the matched loads and the magnetron due to its inherent inefficiencies. The magnitude of the power available from the matched load depends on the area coverage of ink on the paper. For instance, with low area coverage (20%) approximately 250 watts is dissipated in the termination and for high area coverage (greater than 60%) less than 50 watts is dumped into the matching termination. Thus, energy from the termination 80 is not fixed.

The amount of power dissipated in the matching termination 80 depends on the amount of ink deposited on the sheet 14 and the type of coupler 60. It is possible to design a system in which no power is dissipated in the matching termination 80 if the amount of ink deposited on the paper is a known quantity each time. In such a system, the coupler 60 can be designed to couple the required amount of power to the applicator 100 so that no excess power is absorbed by the termination 80. If the ink covered paper is not a matched load, then microwave power which is absorbed in the termination and converted to thermal power can be recycled for convective drying. Consequently, since ink coverage varies over a wide range, the present invention has a wide latitude in drying all types of printed sheets.

Any power that is not absorbed by the ink and paper load is absorbed by the dummy or matched load 80. The magnitude of the power to the dummy load varies with the ink/paper load. For instance, paper with text will result in more power to the dummy load than that of paper with 100% area coverage. Consequently, a matched load must be designed to absorb a wide range of excess power. Also, it is important that the load absorbs all or most (greater than 95%, standing wave ratio less than 1.1) of the incident power, since reflected power from the dummy load results in non-optimized performance of the system, by for instance, the generation of standing waves. Water cooled match loads meet the above requirements for matched loads. However, water cooled matched loads require circulating water maintained at a constant temperature which is not very practical in a low-cost microwave system used to dry paper printed with thermal ink jet ink, especially if used an the office environment.

Consequently, the current invention replaces water cooled matched loads with materials that absorb the excess power and dissipates the absorbed power as generated heat by either natural convection or forced air convection. Also, the absorbing materials chosen have the ability to withstand high temperatures and have a compact thermal mass resulting in a small design.

Figure 8:
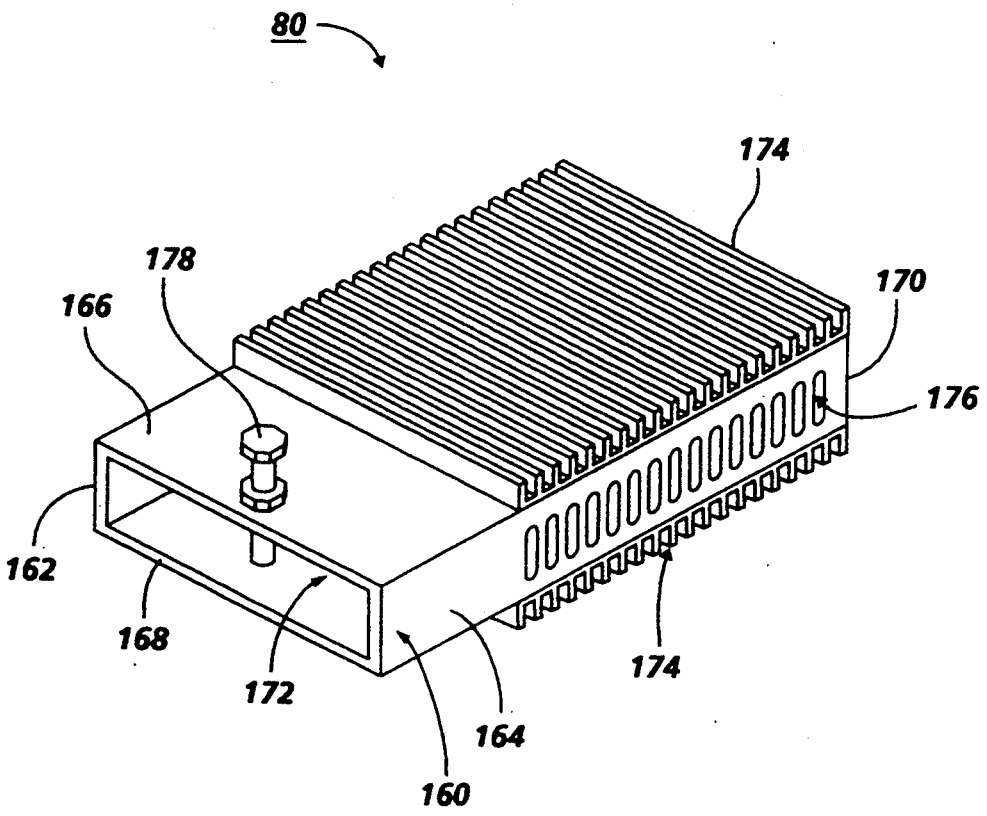
FIG. 8 is a perspective view of a dummy load for a microwave dryer.

FIG. 8 is a perspective view of one aspect of the matched load 80. The matched load 80 includes a waveguide 160 having first and second opposed narrow walls 162 and 164 and first and second opposed broad walls 166 and 168. The waveguide 160 also has an end wall 170 which defines a chamber of the opposed narrow walls 162 and 164, the opposed broad walls 166 and 168 and the end wall 170. The length of the waveguide 160 is chosen according to the requirements of the microwave circuit, as previously described, to enable the microwave dryer to operate as a traveling wave resonating microwave circuit. Microwave power enters the waveguide 160 through an input 172 of the defined chamber.

As illustrated in FIG. 8, a plurality of fins 174 are coupled to the opposed broad walls 166 and 168 to receive heat which is transferred from the interior of the waveguide to the fins. The plurality of fins 174 may be manufactured as separate components and attached to the outer surfaces of the opposed broad walls or can be formed as a part of the opposed broad walls. In addition to the fins 174, a plurality of slots or apertures 176 are defined in each of the opposed narrow walls 164 and 162. A tuning stub 178 is located at the input 172 to the waveguide 160. The fins 174 could be replaced by a plurality of cone shaped or cylindrical shaped members which are attached to and extend from the outside walls of the waveguide thereby enhancing heat dissipation. Likewise, the apertures could be round holes instead of slots. Any combination of fins, protruding members, holes and slots are possible.

The matched load 80 includes a power absorbing body which is located in the waveguide 160. The power absorbing body is a very lossy body. The dielectric loss tangent of the power absorbing body is in the range of 0.01 to 0.1 or, in the alternative, the dielectric constant of the power absorbing body must be on the order of greater than 20. The power absorbing body which is located within the chamber of the waveguide 160 absorbs any excess power which the ink/paper load did not absorb. When receiving the excess power, the energy absorbing body generates heat. The heat is removed from the energy absorbing body and transferred to the fins 174 and through the apertures 176.

Figure 9:
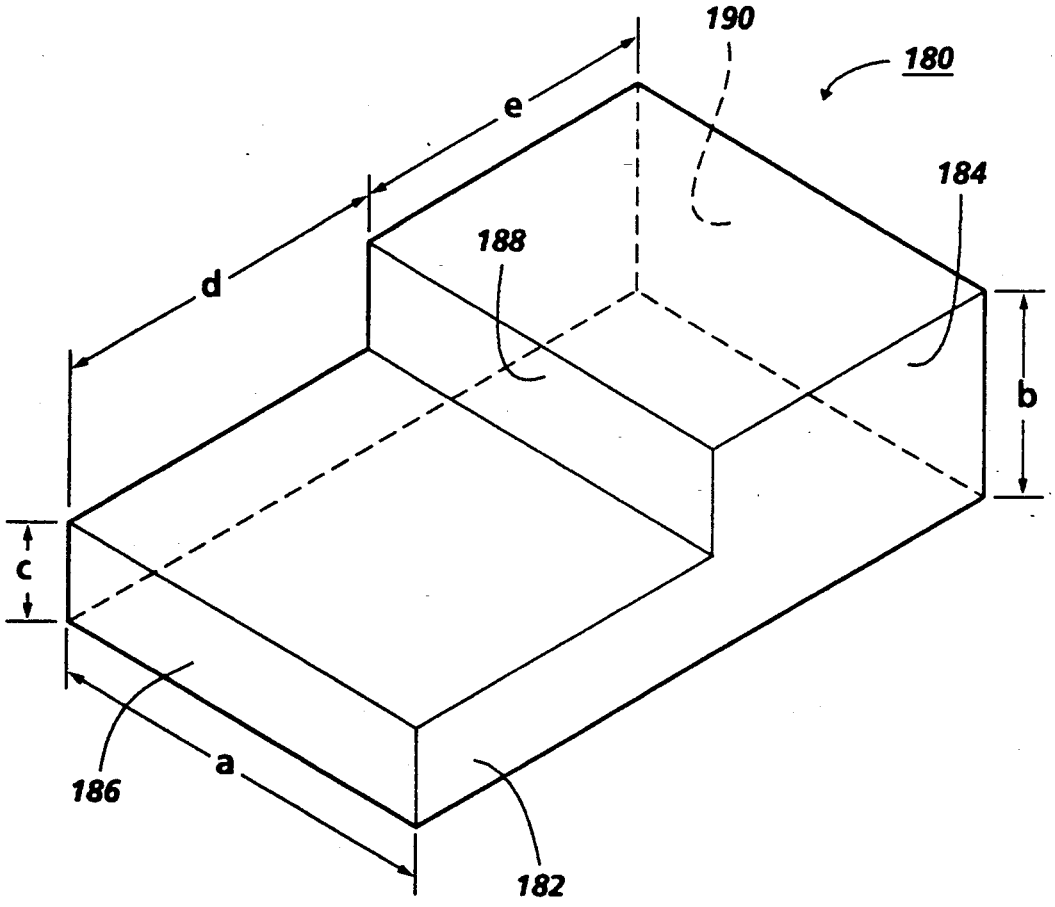
FIG. 9 is a perspective view of a step shaped power absorbing body.

FIG. 9 illustrates a perspective view of one of the power absorbing bodies used in the present invention. The illustrated power absorbing body of FIG. 9 is a stepped load 180 also known as a step taper. The stepped load 180 includes a first step or first plate portion 182 and a second step or second plate portion 184. The stepped load 180 is positioned within the chamber of the waveguide 160 so that a first surface 186 and a second surface 188 are in the path of the incoming microwave power which enters the waveguide 160 through the input 172. A back surface 190 contacts the inside of the end wall 170.

The stepped load 180 is made of silicon carbide. It has been found that sintered silicon carbide is a more preferable material to use in the stepped load than cast silicon carbide. Casted silicon carbide is somewhat like cement. Sintered silicon carbide, however, is injected into a mold at high temperatures and then baked. It has been found that sintered silicon carbide provides a better load than other materials tested. Silicon carbide has the advantage in that it has the ability to heat up to high temperatures without expanding or disintegrating. For the step taper, the electrical properties of the silicon carbide material are fairly stable over a wide range of temperatures. Another aspect of the current invention is that silicon carbide can be formed with a variety of pore sizes. It has been found that smaller pore sizes are used in the natural convective cooling mode while larger pore sizes are used in the forced convective cooling mode. The power absorbing bodies are manufactured by Ferro Corporation, Filtros Plant Division, East Rochester, N.Y.

The stepped load 180 is designed to operate in a small space with a low standing wave ratio of less than 1.01 at the specified frequency of the magnetron. Consequently, the stepped load 180 is preferred over other power absorbing bodies and has a number of dimensions used in the current application. The width of the stepped load 180, here designated as dimension "a" is approximately 2.84 inches or slightly less than 2.84 inches to enable the stepped load 180 to fit within the waveguide 160. The height "b" is slightly less than the width of the waveguide which is currently 0.67 inches. The height of the first surface 186 here labeled as dimension "c" is approximately 0.335 inches, or one-half the height of dimension "b". The length of the exposed portion of the first step portion 182 here labeled as dimension "d", is approximately 2.25 inches or approximately one-quarter of a guide wavelength. The length of the exposed second step portion 184 is greater than 1 inch, here labeled as dimension "e". The length of dimension "e" is not critical, however, it must be sufficiently long to provide enough thermal mass to prevent overheating.

Figure 10:
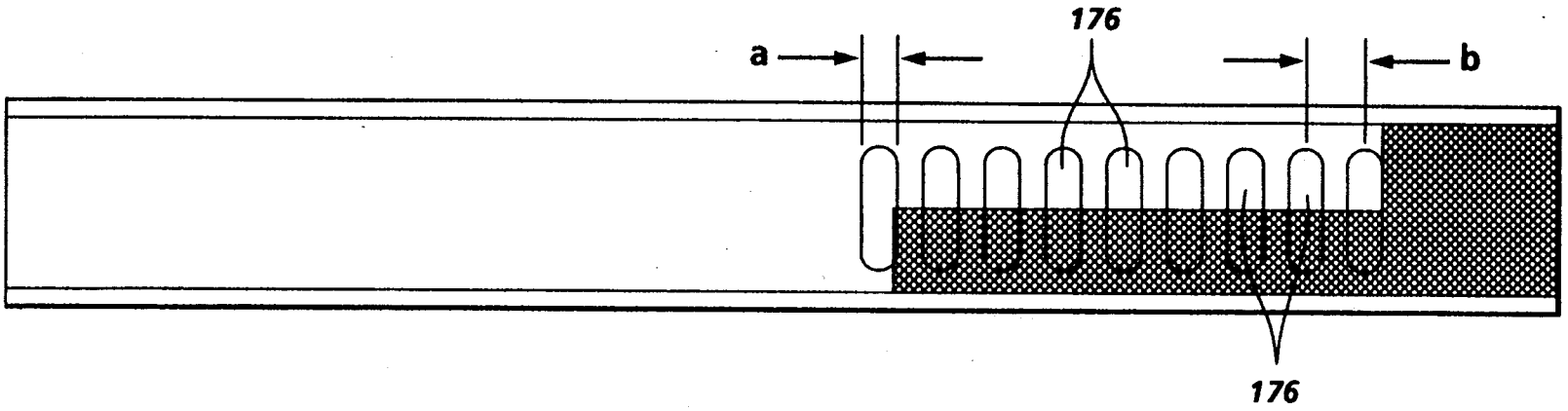
FIG. 10 is a side plan view of a dummy load for a microwave dryer.

FIG. 10 illustrates a side view of the waveguide 160 with the stepped load 180 positioned inside the waveguide. As can be seen, the apertures 176 are positioned along the first step portion 182 but not the second step portion 184 as the second step portion 184 fills the entire height of the waveguide 160. The number of apertures along the side edge of the waveguide 160 is not critical; however, a sufficient number of apertures is necessary to give the required amount of cooling necessary to cool the load. The apertures can also be positioned next to the second step portion. As shown, the width "a" of a particular aperture or slot is 3 mm. The distance between adjacent apertures or slots 176 is approximately 6 mm here shown as dimension "b".

Figure 11:
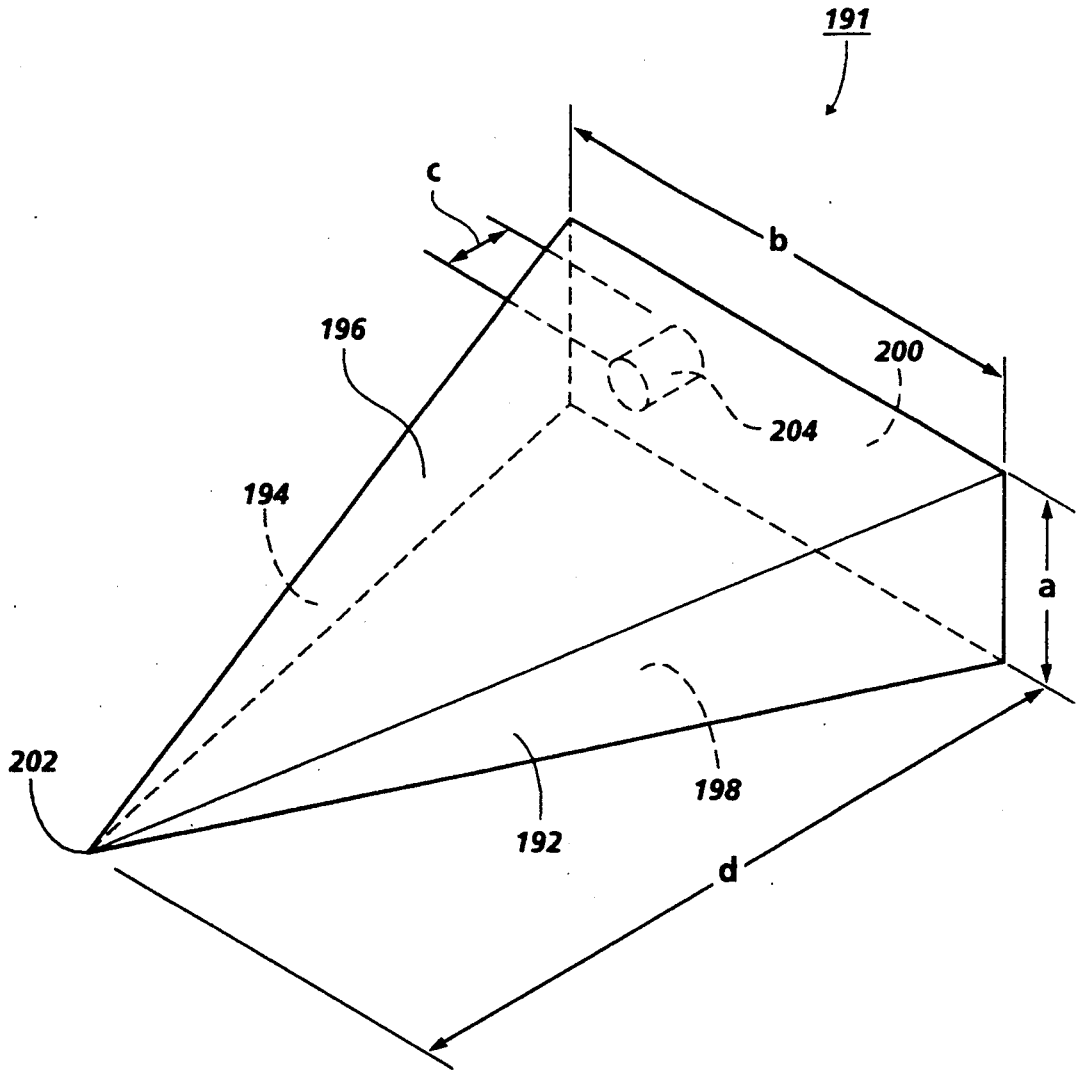
FIG. 11 is a perspective view of a pyramid shaped power absorbing body.

FIG. 11 illustrates a pyramidal tapered power absorbing body 191. The pyramidal tapered power absorbing body 191 is also made of silicon carbide with sintered silicon carbide being preferred. The pyramidal body 191 includes opposed tapered side walls 192 and 194 and opposed tapered top and bottom walls 196 and 198. The tapered side walls and tapered top and bottom walls extend from a base 200 and taper to a point 202. The height of the base here shown as dimension "a" is approximately 0.67 inches or the inside dimension of the waveguide 160. The overall width of the base here shown as dimension "b" is 1.75 inches. The base also includes a mounting hole 204 which is formed in the pyramidal body 191 to accept a mounting screw when the base 200 is mounted flush against the inside surface of the end wall 170. The location of the mounting hole 204 is offset from the center of the base 200 for mechanical convenience and the center thereof is one half of the dimension "a" or 0.335 inches here shown as dimension "c".

A number of pyramidal tapers 191 have been tested. It has been found that the relatively short length of the pyramidal taper here shown as dimension "d" from the backside of the base 200 to the point 202 can range anywhere from 2.5 inches to 4 inches to obtain good results. Pyramidal tapers function well once the temperature is maintained at a low level by forced convective cooling. Centering the base within the inside surface of the end wall 170 provides for good power absorption by the pyramidal taper 191. When using a pyramidal taper as illustrated in FIG. 11, the plurality of slots 176 can run all the way to the end wall 170 as illustrated in FIG. 8.

It is also possible to add additional fins on the opposed narrow walls 162 and 164 in place of the slots 176 for natural convection. Relying on natural convection to keep the load 80 at a reasonable temperature, however, is not as acceptable as providing forced air across the fins 174 and through the slots 176. For instance, applying 500 watts of power to the load 80 without the application of forced air across and through the load 80 results in temperatures of the load 80 reaching approximately 500° F. At such high temperatures, the load can be very reflective. Applying forced air across the fins 174 and through the slots 176, however, lowers the temperature to around 200° F. when the microwave load 80 is receiving approximately 500 watts of power.

Figure 12:
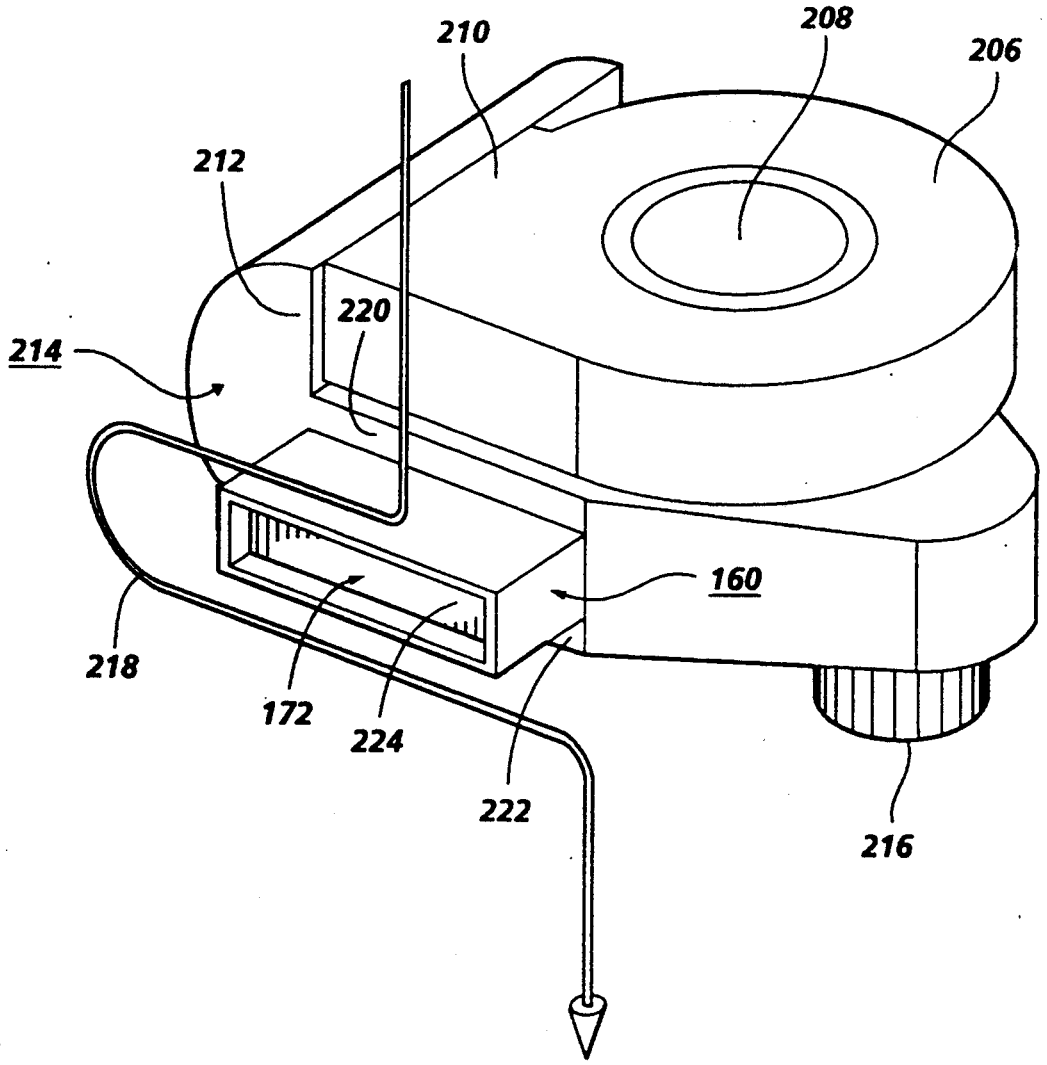
FIG. 12 is a perspective view of a dummy load for a microwave dryer having assisted cooling.

FIG. 12 illustrates a preferred embodiment of the microwave load 80 including a fan 206 for supplying forced air through the waveguide 160. Other cooling fluids besides air can also be used with the appropriate member to move the cooling fluid through the waveguide. The fan currently used is a Howard 24 volt DC fan. The DC fan 206 has an air inlet 208 to supply air through an outlet 210. The outlet 210 is coupled to an inlet 212 of a shroud or housing 214. The fan 206 and housing 214 remove heat which has been transferred to the fins 174 and through the slots 176. The housing 214 surrounds the waveguide 160 and includes an outlet or exhaust 216. As shown in FIG. 12 by an arrow 218, air flow is from the inlet 208, through the outlet 210 to the inlet 212 of the housing 214, through the waveguide 160, and out the outlet or exhaust 216. The housing 214 defines a chamber surrounding the waveguide 160 including the fins 174 which are located on the opposed broad walls 166 and 168. A first portion 220 of the housing 214 surrounds the fins on the top side of the waveguide 160 as illustrated; and, a second portion 222 only partially seen in FIG. 12 surrounds the fins located on the bottom portion of the waveguide 160 as illustrated. In operation, air is withdrawn from the atmosphere and taken through input 208. The air is forced across the fins located on either side of the waveguide 160 and also through the individual slots 176 on the opposed narrow walls 162 and 164.

The characteristics of the load 80 change depending on the temperature of the load 80, and particularly, the temperature of the energy absorbing body. Consequently, it is preferred that the load 80 is tuned with the tuning stub 178 while the load is hot. Therefore, before any paper is printed, the microwave dryer 28 is optimized by adjusting the tuning stub 178 while the load 80 is heated to operating temperature. By adjusting the tuning stub 178 while the load is hot, the reflected power is reduced to approximately zero. Once the load has been heated and the reflections are reduced to zero, the traveling resonating wave circuit can operate at peak efficiency.

In the forced air convective drying mode, the air which passes through the waveguide 160 is heated by the power absorbing body. This heated air can be directed to aid in drying of the individual sheets by connecting the exhaust 216 to the manifold 150 for convective drying as previously described.

An additional feature of the present invention is to provide an air seal 224, shown in FIG. 12 which extends from the opposed broad walls and the opposed narrow walls to create an air seal at the input 172. The air seal is a piece of thin film Teflon TM sheet which is transparent to microwave energy. The air seal 224 closes off the input 172 from the remainder of the microwave applicator to prevent the forced air from passing into the microwave applicator thereby maintaining the flow of air across the fins 174and through the slots 176.

In recapitulation, it is evident that a microwave drying apparatus having the features of the present invention incorporated herein is capable of controlling paper deformation caused by printing with liquid inks. The application of microwave energy to such an ink-laden substrate effectively prevents the formation of cockle and other paper deforming conditions. Any power not absorbed by the paper/ink load is effectively absorbed by the matched load.

It is, therefore, apparent that there has been provided in accordance with the present invention, a load for a microwave dryer that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A dummy load for a microwave dryer comprising:

a waveguide defining a waveguide chamber, said waveguide being provided with a plurality of apertures of a size selected to prevent microwave leakage therefrom;

a solid power absorbing body disposed in the waveguide chamber adjacent said plurality of apertures; and transfer means externally attached to said waveguide for transferring heat away from said power absorbing body and said waveguide.

2. The dummy load of claim 1, wherein said transfer means includes fins.

3. The dummy load of claim 2 wherein said waveguide further comprises opposed broad walls, opposed narrow walls, and an end wall defining said waveguide chamber and at least one of said walls defines said plurality of apertures.

4. The dummy load of claim 3, wherein said power absorbing body contacts one or more of said walls.

5. The dummy load of claim 3, wherein each of said opposed narrow walls define said plurality of apertures.

6. The dummy load of claim 2, wherein said power absorbing body includes a stair step shape.

7. The dummy load of claim 6, wherein said power absorbing body includes a sintered silicon carbide member.

8. The dummy load of claim 2, wherein said power absorbing body includes a stair step shape.

9. The dummy load of claim 1, wherein said power absorbing body includes a sintered silicon carbide member.

10. The dummy load of claim 1, further comprising a removal member disposed on said waveguide to remove heat from said transfer means.

11. The dummy load of claim 10, wherein said removal member includes a housing defining a housing chamber having an inlet and an outlet, said inlet and said outlet defining a path extending through the housing chamber from said inlet to said outlet, said waveguide disposed in said housing, and said transfer means disposed in the path from said inlet to said outlet.

12. The dummy load of claim 11, wherein a portion of said power absorbing body is disposed in the path from said inlet to said outlet.

13. The dummy load of claim 12, wherein said removal member includes an air blower attached to said inlet.

14. The dummy load of claim 13, wherein said waveguide further comprises opposed narrow walls, opposed broad walls and an end wall defining the waveguide chamber, and a seal member extending between said opposed narrow walls and said opposed broad walls to place said power absorbing body between said end wall and said seal member.

15. The dummy load of claim 14, further including a matching stub, said matching stub located in the waveguide chamber between the source of microwave energy and said power absorbing body.

16. The dummy load of claim 11, wherein said transfer means includes fins.

17. The dummy load of claim 16, wherein said waveguide further comprises opposed narrow walls, each of said opposed narrow walls defining said plurality of apertures.

18. The dummy load of claim 17, wherein each said plurality of apertures is a slot having a length extending in a direction substantially parallel to a height of said narrow walls.

19. The dummy load of claim 11, wherein said power absorbing body includes a stair step shape.

20. The dummy load of claim 19, wherein said power absorbing body includes a sintered silicon carbide member.

21. The dummy load of claim 11, wherein said power absorbing body includes a pyramidal shape.

22. The dummy load of claim 21, wherein said power absorbing body includes a sintered silicon carbide member.

23. A microwave dryer utilizing convective drying, comprising:

a source of microwave power;

a microwave power applicator coupled to said source of microwave power for applying microwave power generated by said source of microwave power;

a matched load, coupled to said applicator, including a waveguide defining a waveguide chamber, said waveguide being provided with a plurality of aperture of a size selected to prevent microwave leakage therefrom, and a power absorbing body disposed in the waveguide chamber next to said plurality of apertures; and a directing member associated with said waveguide for directing heat away from said matched load to said microwave power applicator.

24. The microwave dryer of claim 23, further including transfer means externally attached to said wave guide for transferring heat from said power absorbing body and said waveguide.

25. The microwave dryer of claim 24, further comprising a seal member disposed in the waveguide chamber separating said applicator from said power absorbing body.

26. The microwave dryer of claim 25, further including a matching stub, said matching stub located in the waveguide chamber between said source of microwave power and said power absorbing body.

27. The microwave dryer of claim 26, wherein said microwave power applicator comprises a serpentine applicator.

28. The microwave dryer of claim 24, wherein said directing member includes a housing defining a housing chamber having an inlet and an outlet, with the inlet and the outlet defining a path extending through the housing chamber from the inlet to the outlet, said waveguide being disposed in the housing chamber of said housing, and said transfer means and said plurality of apertures disposed in the housing chamber for the path from the inlet to the outlet.

29. The microwave dryer of claim 28, further comprising a seal member disposed in the waveguide chamber separating said applicator from said power absorbing body.

30. The microwave dryer of claim 29, further including a matching stub, said matching stub located in the waveguide chamber between said source of microwave power and said power absorbing body.

31. The microwave dryer of claim 30, wherein said microwave power applicator comprise a serpentine applicator.

32. The microwave dryer of claim 28, wherein said power absorbing body comprises a solid material.

33. The microwave dryer of claim 32, wherein said power absorbing body has a dielectric loss tangent in the range of 0.01 to 0.1.

34. The microwave dryer of claim 33, wherein said power absorbing body comprises a sintered silicon carbide member.

35. The microwave dryer of claim 34, further comprising a seal member disposed in the waveguide chamber separating said applicator from said power absorbing body.

36. The microwave dryer of claim 23, wherein said power absorbing body comprises a solid material.

37. The microwave dryer of claim 36, wherein said power absorbing body has a dielectric loss tangent in the range of 0.01 to 0.1.

38. The microwave dryer of claim 37, wherein said power absorbing body is a sintered silicon carbide member.

* * * * *